US005287567A

United States Patent [19]

Eash et al.

[11] Patent Number: 5,287,567

[45] Date of Patent: Feb. 22, 1994

[54] HYDRAULIC ISOLATION MANIFOLD

[75] Inventors: Willard L. Eash, Valrica; Paul F. Fulmer, Plantation, both of Fla.

[73] Assignee: Horner Equipment of Florida, Inc., Ft. Lauderdale, Fla.

[21] Appl. No.: 30,564

[22] Filed: Mar. 12, 1993

[51] Int. Cl.[5] ..... E04H 4/12

[52] U.S. Cl. ..... 4/493; 126/374; 237/1 R

[58] Field of Search ..... 4/493, 509, 541.1, 541.2; 126/344, 374, 366, 390, 391, 392; 237/1 R

[56] References Cited

U.S. PATENT DOCUMENTS

| | | | |
|---|---|---|---|
| 3,623,165 | 11/1971 | Whittell, Jr. | 4/493 |
| 3,781,925 | 1/1974 | Curtis et al. | 4/493 |
| 3,837,016 | 9/1974 | Schindler et al. | 4/493 |
| 3,988,787 | 11/1976 | Colee | 4/493 |
| 4,001,899 | 1/1977 | Mathis | 4/493 |
| 4,052,757 | 10/1977 | Dotson | 4/493 |
| 4,240,165 | 12/1980 | Kyrias | 4/493 |
| 4,529,033 | 7/1985 | Blom | 237/1 R |
| 4,621,613 | 11/1986 | Koumhansl | 4/493 |
| 4,761,838 | 8/1988 | Hargrove | 4/541.2 |
| 5,117,233 | 5/1992 | Hamos et al. | 4/541.1 |

*Primary Examiner*—Henry J. Recla
*Assistant Examiner*—Charles R. Eloshway
*Attorney, Agent, or Firm*—Clifford A. Poff

[57] ABSTRACT

A time shared arrangement for delivering spa water and pool water to a water heater is disclosed in which check valves respond to the presence of spa water and pool water pressure. Water drawn from the pool is diverted into two streams, one passes through a check valve to a water heater and the other passes through a check valve to a return line. The flow of pool water to the heater is isolated by a further check valve forced to a close position by the pressure of the pool water. Water drawn from the spa is diverted into two streams, one passes through a check valve to a water heater and the other passes through a check valve to a return line. The flow of spa water to the heater is isolated by a check valve forced is closed by the pressure of spa water. Separate check valves are used for the diverted flows of each water stream to reduce pressure loss and provide a uniquely located site where a signal can be derived indicated by operation of the spa water pump or in the absence thereof a control parameter indicative of operation of the pool water pump.

10 Claims, 3 Drawing Sheets

HYDRAULIC ISOLATION MANIFOLD

BACKGROUND OF THE INVENTION

1. Field of the Invention

The present invention relates to a hydraulic isolation manifold for an automatic temperature and valving control system to supply heated water from a heater to a swimming pool and to a spa which may be interconnected by a spill way. More particularly, the present invention relates to such a system wherein a header assembly embodies a unique arrangement of hydraulically operated valves to control directed flows of water from a swimming pool and a spa without incurring adverse effects to the water pressure because of the valving.

2. Description of the Prior Art

Current pool heating systems accomplish specific needs for the routing of pool or spa water through a heater on a time shared basis. Three-way valves and "T" fittings allow closing of any branch to isolate the pool water, direct it through the heater and return it to the pool or to the spa when water flow via the spa spill-over is desired. In a contrary position, the valves operate to isolate the spa water from the pool and direct the water pumped from the spa through the heater and back to the spa. Motorized actuators can be fitted to such valves for automated operation. Common valves of gate, globe, ball or butterfly varieties are used to isolate pool or spa water to share the same heater. Normally, four common valves are necessary, namely: one to prevent spa water from entering the heater during pool heating; one to prevent pool water from entering the spa during spa heating; one to direct pool water to enter the heater, and one to return water to the pool.

The present invention is an improvement to the known time sharing heater techniques and particularly as disclosed in Service Bulletins Volume II, Issue IX, dated September, 1985, and Volume V, Issued VII, dated July, 1988, by Horner Equipment of Florida, Inc. According to this body of known heating pool technology, hydraulic isolation valving for combined spa and pool structures is devised for the pool water and spa water. All the water pumped from the spa was required to pass through a single check valve imposing a detrimental water pressure drop before a part of the spa water entered the heater and a diverted part passed through another check valve in a return line where heated water from the heater was introduced to form a combined flow for return to the spa. Such a system suffered from pressure drops imposed by a check valve to the entire spa water flow before division to form the partial flow to the heater; thus downgrading the much desired turbulent water condition in body of water in the spa. Also, the piping in such hydraulic isolating systems was of a random nature whereby the valving was not centralized and pipe sizes were often wrongly chosen, thus degrading the effectiveness of the system. The diverse nature of hydraulic isolation systems imposed severe restraints to the temperature control system because there was ordinarily required an interlock between a time clock or pool pump with the heater thermostat controls. Such interlock was job site dependent and required interlocking of a flow switch or an external relay in a time clock, or pump with heater thermostats for the switching operations.

Current pool and water heating technologies also offer devices to accomplish temperature setting functions for control of pool or spa water through a shared heater. Manual electrical switches can be used to designate one of two thermostats or potentiometers for controlling water heater operations for pool water and spa water. No centrally derived signal could be generated to select which of the two thermostats or potentiometers would be used for heater operation because flow detection was always a site specific circumstance. The water pressure detecting switches had to be situated in the piping before the flow of water was diverted and selected for the water heating operation. Because of this, the chosen site along the piping was likely remote to the water heater and independent of the usual sensor in the water heater that would assure identification of pool or spa water flow therein as a fail safe measure. Electronic pool/spa controllers are also available to the industry for remote operation, thermostat setting, time sequencing, and valve activation, but these devices do not relate or utilize the hydraulic principles of this invention and therefore unduly complicate the entire control system.

It is therefore an object of the present invention to provide a manifold for combining functions into an integral central system using hydraulic isolation principles for water circulating controls.

It is another object of the present invention to provide a water flow control system in which a unitary header structure embodies a construction to allow preassembly and inclusion within the cabinet structure of a water heater for a pool and spa so as to centralize the servicing and control of structures essential to the time sharing heating operation of water by the water heater.

It is a further object of the present invention to provide a chamber unique in the operation of a hydraulic isolation manifold to allow reliable detection of spa water pump and pool water pump operations for a basis to initiate thermostatic controls.

SUMMARY OF THE INVENTION

According to the present invention there is provided a a water flow control system for a swimming pool and a spa, the system includes a water heater having a first flow rate for water between a water inlet and a water outlet opening, a first means includes a pump for supplying water from the swimming pool at a second flow rate which is at least equal to but preferably greater than the first flow rate, a second means includes a pump for supplying water from the spa at a third flow rate which is greater than the first flow rate, a flow control heated having a water supply duct communicating with the water inlet of the water heater between spaced apart water inlet ducts communicating with the first and second means, the first valve means is responsive to the water pressure difference between the first flow rate and the second flow rate for causing a partial flow of pool water to the water heater and a diverted flow of pool water to a first return line, and the second valve means responsive to a water pressure difference between the first flow rate and the third flow rate for causing a partial flow of spa water to the water heater and a diverted flow of spa water to a second return line.

In a preferred form of the present invention one of the aforesaid water inlet ducts of the flow control header forms a pressure detection chamber unique in the system by its isolation through operation of the first and second valves to derive a control signal to select one of different thermostatic controls for a water heater.

BRIEF DESCRIPTION OF THE PREFERRED EMBODIMENTS

The present invention will be more fully understood when the following description is read in light of the accompanying drawings in which.

DETAILED DESCRIPTION OF THE PREFERRED EMBODIMENTS

Figure 1:
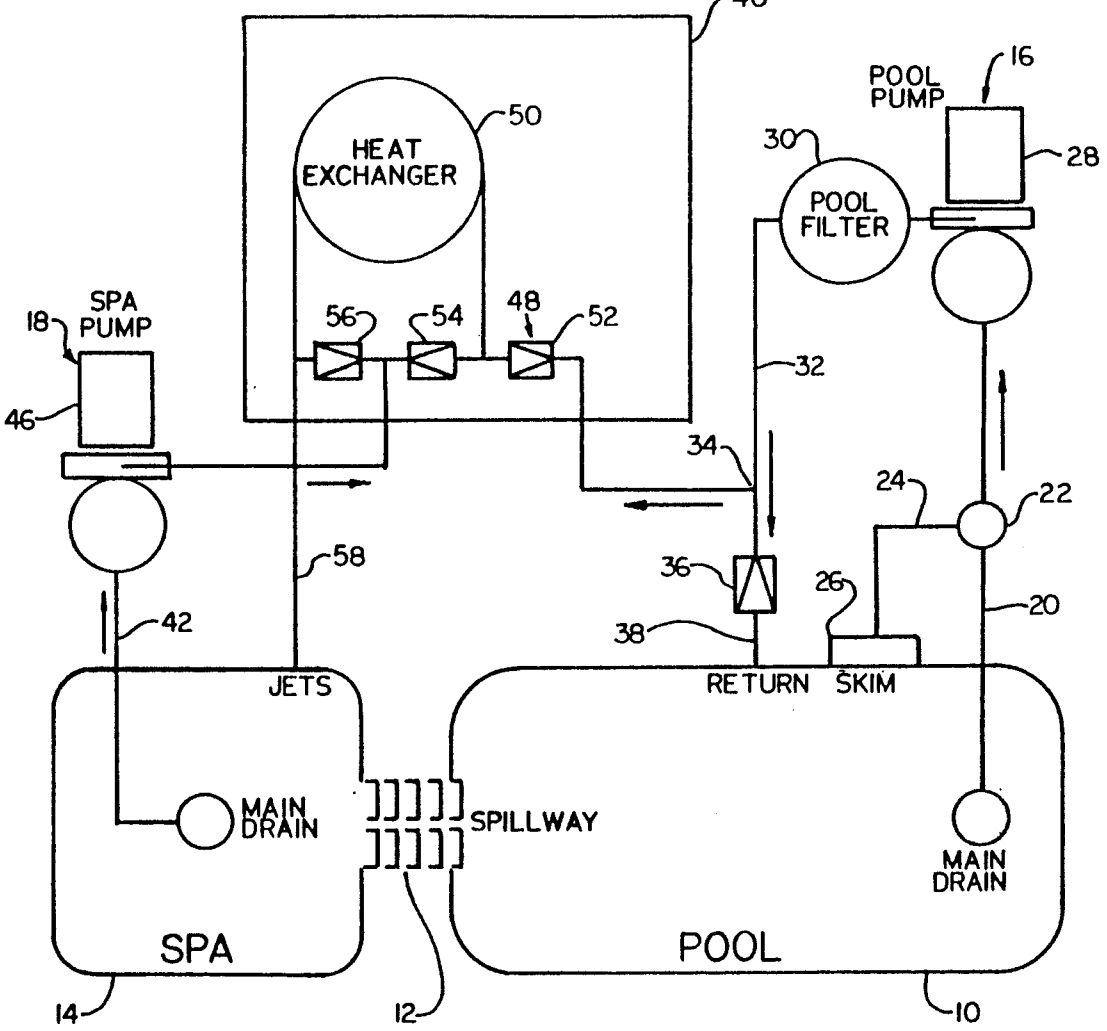
FIG. 1 is a schematic illustration of a hydraulic isolation manifold in a combined spa and pool water flow system according to a preferred embodiment of the present invention.

In FIG. 1 there is illustrated a preferred embodiment of water flow control system for time-shared use of a heater to heat water for a spa and swimming pool. The swimming pool is identified by reference numeral 10 and receives water by way of spillway 12 from a spa 14. Other forms of water flow interconnections can be used without departing from the spirit of the present invention. The swimming pool, spill-way, and spa are all structures well known in the art per se. In the embodiment of FIG. 1, it is preferred that the pool water is heated by the flow of heated water from the spa by way of the spill way to the pool. Thus, it is to be understood that heated water from the water heater is supplied exclusively to the spa or as will be explained hereinafter, directed by additional valving to a pool when desired. A drain line 20 communicates with an opening in the floor of the pool and joined by a "T" 22 to a line 24 that receives pool water from a skimmer 26 in a sidewall of the pool. The combined water flow from the skimmer and the drain line is developed through operation of a pump 28 that delivers the pool water to a filter 30 having an output line 32 that is branched by a "T" 34. Filter 30 is part of the usual water conditioning components that may induce a partial flow of conditioned pool water to be returned to the pool through the check valve 36 by line 38. Check valve 36 is part of a header system according to the present invention for establishing a partial flow to the hydraulic isolation valving within a time shared water heater 40.

The spa 14 has a drain line 42 that receives spa water through an opening in the floor of the spa for delivery under pressure developed by a pump 46 to a flow control header 48 forming an essential part of the water flow control system of the present invention. In one embodiment of the present invention and as shown in FIG. 1, the header is physically situated within the confines of the cabinet serving to house the water heater 40. The water heater is energized to heat a flow of water by any suitable well known medium which in warm climate preferably consists of a heat pump system that essentially includes a heat exchanger 50 wherein heat is transferred to water for the heating process. The medium which supplies the source of energy for heating the water passed through the water heater may be any of diverse sources including, by way of an example, gas, electric and solar energy sources. The flow of water through the heat exchanger occurs at a much smaller rate than the water flow rate delivered by either pool pump 28 and spa pump 46. By way of an example but in no way limiting the present invention, spa pumps generate a spa water flow rate that is many times greater than can be accommodated by the duct in the heat exchanger. Header 48 includes in addition to the check valve 36 tandemly arranged check valves 52, 54 and 56 whose operation is such that heated water derived in the output line 58 from the heat exchanger is delivered by a line 58 to discharge jets in the walls commonly situated in the side walls of the spa. The details of the construction of the header 48 can be best seen from FIG. 2 in which a main part of the header embodies a design capable of mass production techniques from standard, off the shelf components to insure reliable operation through required uniform pipe sizes and predetermined check valve operating pressures. In this regard, check valves 36 and 56 require an operating pressure due to the force exerted by their respective springs 36A and 56A on plungers 36B and 56B that is much greater by a factor of 10 or greater than the pressure needed to unseat check valve plungers 52A and 54A by the pressure imposed by the associated springs 52B and 54B. The arrangement of these check valves enables the unique hydraulic isolation operation in the header system. Check valve 52 receives a partial flow of pool water from the "T" 34 through an elbow 60 which is aligned with an opening in the front panel of the cabinet for the water heater.

Figure 2:
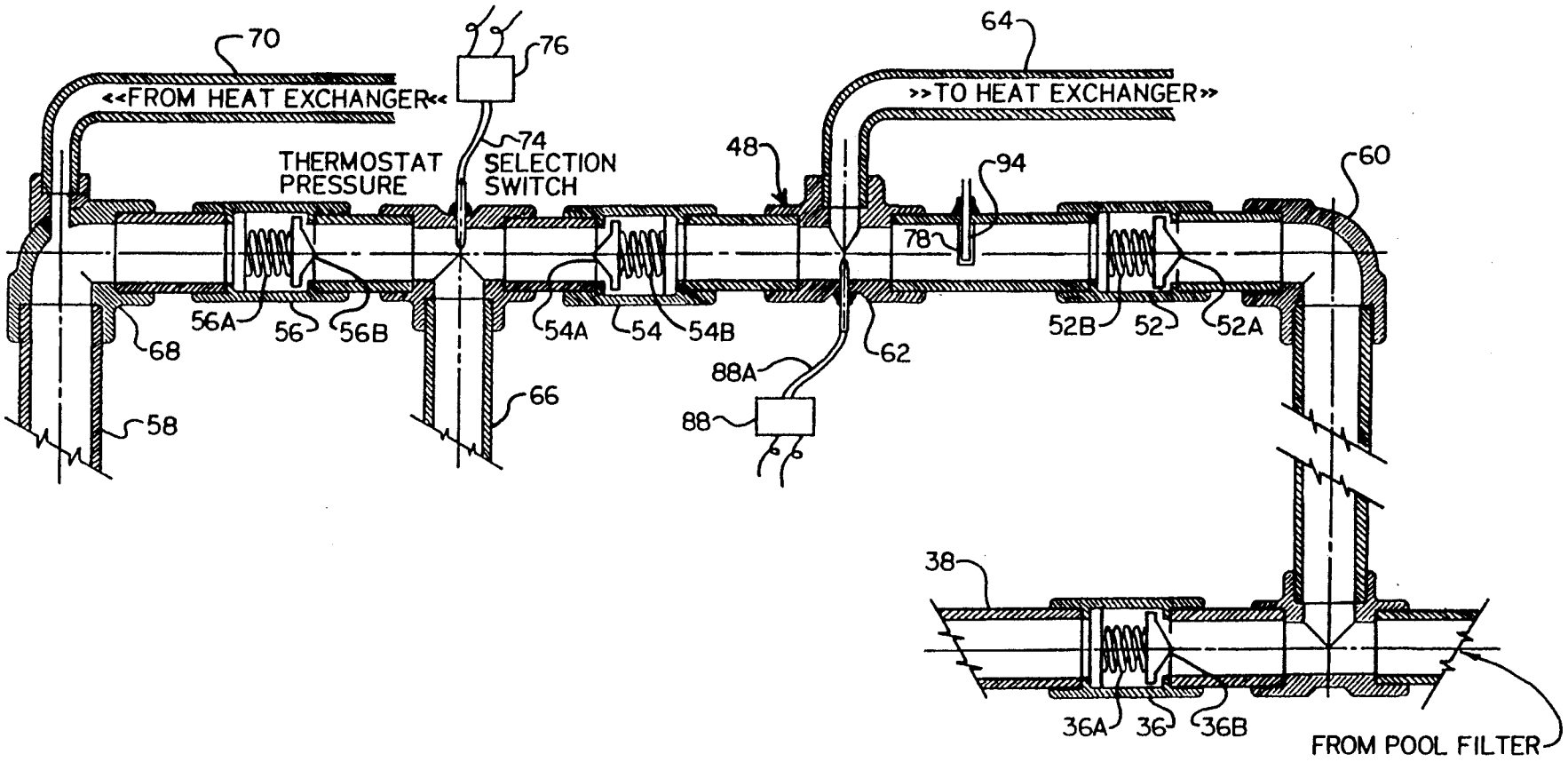
FIG. 2 is a sectional view through a flow control header embodying the features of the present invention.

The partial flow of pool water passing the check valve by unseating the plunger 52A enters a "T" 62 having a branched conduit that is of a much smaller diameter by a factor of 3 as compared to the diameter in the throughput leg connected to check valve 54. It is common practice, but not limited to, that the diameter of a conduit 64 to the heat exchanger is smaller because the heat exchanger sizes vary for efficient heat transfer to the water. The opposing end of the "T" 62 is joined to the housing of check valve 54. Check valves 52 and 54 are oppositely disposed, as shown in FIG. 2, so that when pool water is supplied to elbow 60, check valve 52 unseats and check valve 54 is urged by pressurized water into a seated condition. Under these circumstances the partial flow of the water is exclusively directed to the water heater. When the spa pump is operated and the pool pump is not operated, check valve 54 is acted upon by a partial flow of water under pressure from the spa, as applied against the plunger of the check valve by a "T" 66. The diverted part of the partial flow created by "T" 66 is applied to the plunger of check valve 56 causing it to be unseated and direct the partial flow in "T" 68 where the flow is joined with heated water discharged from the heat exchanger by a reduced diameter conduit 70 connected to the "T" 68. The combined flow of water emerges from the "T" where it is conducted by a line 58 for return to the jets of the spa as described previously.

The arrangement of valving according to the present invention allows the creation of a unitary manifold assembly incorporating each of check valves 52, 54 and 56 that can be protectively housed within a cabinet of a water heater. The necessary water inlets and outlets from the manifold can be accomplished through convenient openings in the cabinet wall. This feature of the present invention assures matching of the flow characteristics of the header with the water heater at an assembly site that can be at a point of manufacture, if desired. This allows all interconnecting piping from electrical controls to be installed before set-up operations at a pool and spa site.

Figure 3:
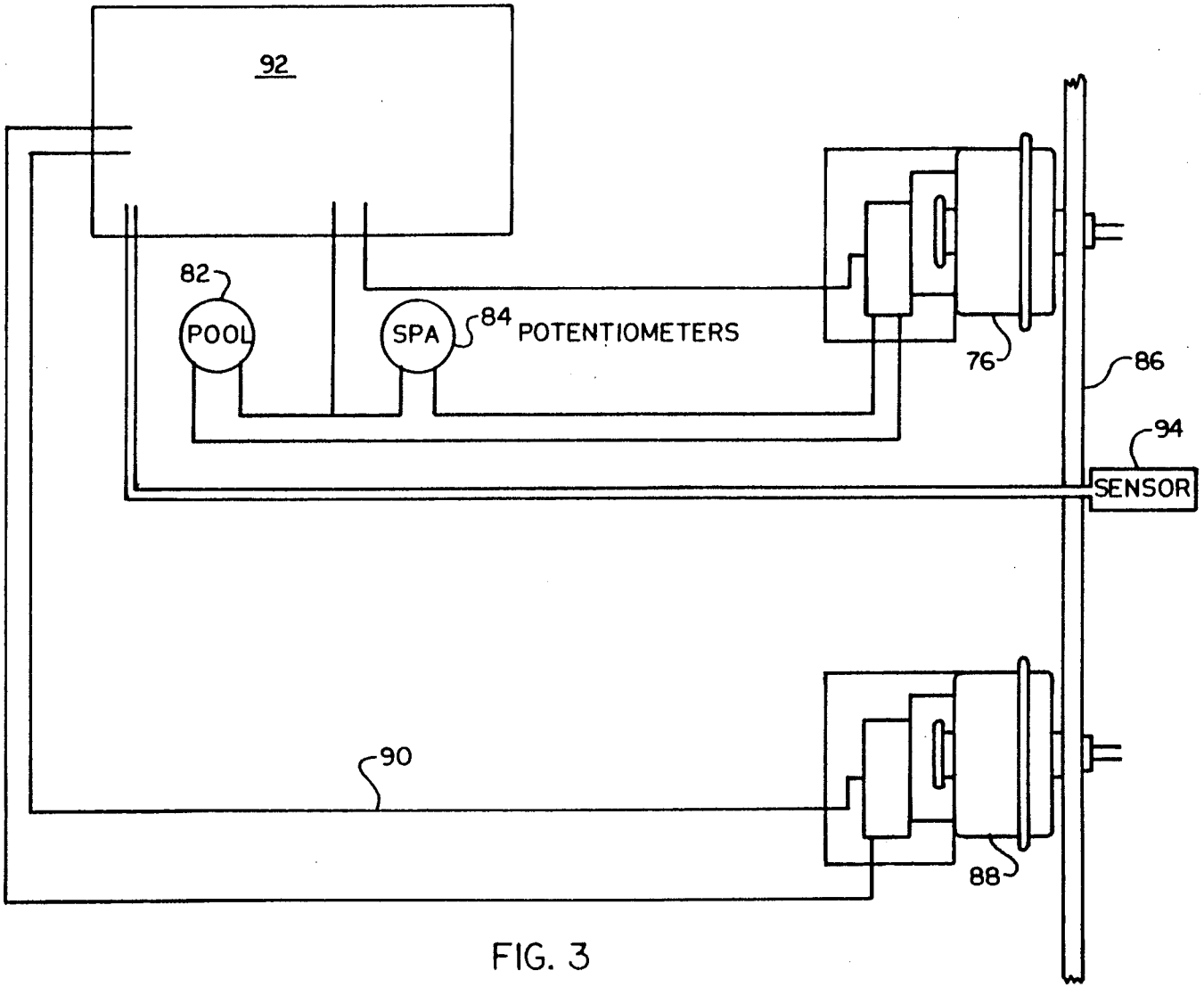
FIG. 3 is an schematic illustration of the control system to control the heater for heating water for a swimming pool and spa.

A further feature of the present invention resides in the unique creation and utilization of the chamber within "T" 66 which communicates with an opening 74 by which water pressure in the "T" is applied to a switch 76. Switch 76 is part of a control system that further utilizes a temperature measurement provided by a heat sensor 94 housed within a probe 78 that is inserted in a water tight manner in an opening formed in "T" 62 to provide the measure of the temperature of the water supplied to the "T". The water temperature detected by the heat sensor 94 is converted to an electrical signal which is applied to a printed circuit board control 92. Water supplied to the "T" 62 can have its origin in either the spa or the pool depending on which of the respective water pumps is actuated. The water pressure detected by switch 76 in the "T" 66 uniquely indicates that the spa pump is operating and supplying water to the header, thus, allows a separate thermostatic control of the spa water temperature. In the absence of a detected water pressure in "T" 66, a second thermostat is activated to control the temperature of the pool water. The thermostatic controls can be best understood when referring to FIG. 3. The switch 76 includes controllers that receive signals responsive to the settings by potentiometers 82 and 84 representative of the individual desired water temperatures to be obtained through operation of the time shared heater by the pool and spa, respectively. Switch 76 is mounted on an internal wall 86 supported inside the cabinet of heater 40. The heat sensor 94 which is housed within probe 78 supplies an output signal by wires 90 to input terminals of a controller board 92. The actual water temperature signal provided by the sensor 94 allows comparison with a set point thermostat signal from potentiometers 82 and 84, separately, so that a deficient temperature of pool or spa water can be determined and adjusted through operation of the heater. The heat exchanger is energized only in response to and only in the continued presence of an output signal from a water pressure transducer 88 coupled by a tubing 88A to a fitting communicating with the body of water in "T" 62. The output signal from transducer 88 is applied by lines 90 to controller board 92 whereby an safety overriding control of the water heater operation is provided. The configuration and arrangement of operating valves and other structure shown in FIG. 2 is designed, expressly for protective housing within the cabinet of the water heater. However, it is to be understood that heater system embodying the features of the present invention may take different configurement and still embody the features of the present invention.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

We claim:

1. A water flow control system for a swimming pool and a spa, said system including:

a water heater having a first flow rate for water between a water inlet and a water outlet;

first means including a pump for supplying water from said swimming pool at a second flow rate which is at least equal to said first flow rate;

second means including a pump for supplying water from said spa at a third flow rate which is greater than said first flow rate;

a flow control header having a water supply duct communicating with the water inlet of said water heater between spaced apart water inlet ducts communicating with said first and second means;

first valve means responsive to a water pressure difference between said first flow rate and said second flow rate for causing a partial flow of pool water to said water heater and a diverted flow of pool water to a first return line which communicates between the header and the pool; and second valve means responsive to a water pressure difference between said first flow rate and said third flow rate for causing a partial flow of spa water to said water heater and a diverted flow of spa water to a second return line which communicates between the header and the spa.

2. The system according to claim 1 wherein said first valve means includes check valves responsive to essentially only said water pressure difference between the first flow rate and the second flow rate.

3. The system according to claim 1 wherein said second valve means includes check valves responsive to essentially only said water pressure difference between the first flow rate and the third flow rate.

4. The system according to claim 1 wherein said first valve means includes two check valves one of which isolates spa water flow from said water heater and the other of which valves operates to cause said directed flow of pool water in said first return line.

5. The system according to claim 1 wherein said second valve means includes two check valves one of which isolates pool water flow from said water heater and the other of which valves operates to cause said directed flow of spa water in said second return line.

6. The system according to claim 1 wherein one of said water inlet ducts of said flow control header forms a water pressure detection chamber isolated by operation of said first and second valve means and wherein said system further includes water pressure detection means communicating with said water pressure detection chamber for deriving a control signal indicative of a supply of water of said swimming pool and indicative of said supply of water of said spa.

7. The system according to claim 1 further including a cabinet for said water heater and said header and wherein said header comprises a unitary structure including at least some of said first and second valve means protectively housed in said cabinet while allowing access through a wall of said cabinet for the supply and delivery of the pool and spa water.

8. The system according to claim 1 wherein said second flow rate is greater than said first flow rate.

9. The system according to claim 1 wherein said inlet duct for pool water includes two branches, one defining said partial flow of pool water and the other defining said diverted flow of pool water, and wherein said first valve means comprises discrete check valves operatively situated one in said first return line, and the other situated between the inlet of the second means and the inlet of the water heater.

10. The system according to claim 1 wherein said inlet duct for spa water includes two branches, one defining said partial flow of spa water and the other defining said diverted flow of spa water, and wherein said second valve means comprises discrete check valves operatively situated one in said second return line, and the other situated between the inlet of the first means and the inlet of the water heater.

* * * * *